US006612655B2

(12) United States Patent
Schwoebel et al.

(10) Patent No.: US 6,612,655 B2
(45) Date of Patent: Sep. 2, 2003

(54) MINING SYSTEM AND METHOD FEATURING A BREAD LOAF SHAPED BOREHOLE

(75) Inventors: Jeffrey J. Schwoebel, Free Union, VA (US); Donald B. Sult, Charlottesville, VA (US); Rudy Paul Zych, Columbus, OH (US); Jerry O'Keefe, Newark, OH (US); George Coleman, Bristol, TN (US)

(73) Assignee: Amvest Systems Inc., Charlottesville, VA (US)

( * ) Notice: Subject to any disclaimer, the term of this patent is extended or adjusted under 35 U.S.C. 154(b) by 0 days.

(21) Appl. No.: 09/791,267

(22) Filed: Feb. 22, 2001

(65) Prior Publication Data

US 2002/0113484 A1 Aug. 22, 2002

(51) Int. Cl.[7] ..... E21C 41/00; E21C 25/16
(52) U.S. Cl. ..... 299/29; 299/55; 299/85.1
(58) Field of Search ..... 299/51, 55, 56, 299/85.1, 1.6, 1.4, 29, 39.2, 58, 95, 41.1, 17

(56) References Cited

U.S. PATENT DOCUMENTS 2,734,731 A * 2/1956 Cartlidge et al. ..... 198/506
2,868,528 A * 1/1959 Cartlidge et al. ..... 299/59
3,086,761 A * 4/1963 McWhorter ..... 299/57
3,407,006 A * 10/1968 Brill et al. ..... 175/91
3,734,214 A * 5/1973 Benetti et al. ..... 175/171
4,159,055 A * 6/1979 Eberle ..... 198/512
5,114,213 A * 5/1992 Kornecki et al. ..... 299/17
5,212,895 A * 5/1993 Camilleri ..... 299/82.1
5,553,926 A 9/1996 Blackstock et al. ..... 299/10
6,296,317 B1 * 10/2001 Ollis et al. ..... 299/1.05

FOREIGN PATENT DOCUMENTS

DE 3410121 A1 * 3/1985 ..... E21D/9/10

* cited by examiner

*Primary Examiner*—David Bagnell
*Assistant Examiner*—Daniel P Stephenson
(74) *Attorney, Agent, or Firm*—Jenkens & Gilchrist, P.C.

(57) ABSTRACT

A method and apparatus for cutting a borehole substantially in the shape of a bread loaf within a mine includes four cutting systems. The first cutting system is a pair of three-armed, counter rotating, cutting heads which remove material from the mine face in a substantially vertical plane. The second cutting system is a pair of rotating cutting drums which follow the pair of counter rotating cutting heads. The third cutting system is a substantially vertical, rotating cutting head which removes the kerf formed at the ceiling or roof portion of the borehole. The fourth cutting system is a plow which both removes the kerf at the bottom of the borehole and directs the mined material to a conveyor system to remove the mined material from the mine.

20 Claims, 6 Drawing Sheets

MINING SYSTEM AND METHOD FEATURING A BREAD LOAF SHAPED BOREHOLE

FIELD OF INVENTION

The present invention pertains to a mining system and method for excavating a borehole within a mine. Specifically, the present invention pertains to a mining apparatus which implements the disclosed mining method and produces a bread loaf shaped borehole in a coal seam.

BACKGROUND

It is well known that an arch provides a stable structure that is used frequently in the construction of both bridges and dams. An arch generally provides better spanning and improved stress distribution. Because of the force distribution provided by an arch, the greater the load above the arch, the greater the compressive forces within the structure above the arch. These compressive forces lead to greater stability and security of the structure, which includes an arched shaped opening.

In underground mines, particularly coal mines, either the size of the coal seam, the type of the equipment used for mining the coal, or the need to provide space for miners to work has prevented the effective use of an arched borehole to provide stability and security within the borehole in a mine. One prior art mining machine, set forth in U.S. Pat. No. 5,553,926 issued to Blackstock et al., utilizes an elliptical cutting drum to produce a borehole having a curved roof and bottom. However, this solution tends to compromise haulage systems, which are typically configured to operate in boreholes having a flat bottom or floor. Accordingly, mines having boreholes formed using prior art methods and equipment have typically utilized a variety of different roof or ceiling supports to keep the roof or ceiling of the mine from collapsing into the borehole. As mining operations have expanded into smaller seams and have implemented more sophisticated, remotely-operated equipment, the need has arisen to utilize the stability of the arch to enhance the inherent stability and security of the borehole within a mine. The utilization of arch-shaped borehole mining techniques will provide for a deeper penetration into a mine, reduce the expense and inconvenience associated with shoring or providing support for the roof or ceiling of the borehole, and potentially allow development of coal reserves with poor roof conditions.

In addition to the need for providing stability and security for the excavated opening or borehole in the mine, there is also a need to provide a flat surface over which cutting and conveying equipment may be easily moved both to cut mining material from the face of the mine at the end of the borehole and to transport the mined material away from the face of the mine and out of the borehole to a collection point.

Underground openings with an arched top and flat bottom are not uncommon, and such designs may be observed in large underground transportation tunnels. However, because of the nature of mining operations, the size and shape of the borehole within a mine has been determined both by the shape of the reserve or ore deposit, such as a coal seam, and the space required to accommodate mining equipment. In contrast to a transportation tunnel, in which a passage is created between two points, a mining borehole is directed to the recovery of a product, namely coal, minerals and ore. As mining operations have expanded into areas previously unaccessible to human beings through the use of smaller, more sophisticated, remotely operated, computer controlled mining equipment, the desirability of creating a borehole with an arched top and flat bottom has once again become a viable consideration for designers of sophisticated mining equipment.

Accordingly, there is a need for a mining method using mining equipment that can operate in coal seams or ore deposits whose size may be too small for people to comfortably work in, which method should provide all of the structural stability and security benefits from an arched roof configuration and all of the transport and operational benefits associated with a flat floor. Such method should also enable the use of apparatus that is simple in both construction and operation.

SUMMARY

The mining method and mining apparatus of the present invention obtains the structural and security benefits of an arched roof configuration and the transport and operational benefits of a flat floor by creating a borehole within a mine having a perimeter substantially the same as the profile or outline formed by a loaf of bread (i.e., a rounded top, flat sides and a flat bottom). Further, the present invention is less complex in operation than many other prior art mining systems.

To create a bread loaf shaped borehole, the mining method and apparatus of the present invention features the combination of four cutting systems together with three cutting support systems.

The largest of the four cutting systems is a pair of counter rotating, multi-armed cutting heads. As depicted herein, these cutting heads may have three a structural members or arms that are equally spaced apart, but it is understood that other geometries or configurations are clearly possible, such as two, four or even five armed cutting heads. These two large cutting heads use both mechanical bits and high pressure water jets, cutting independently, to remove mined material from the face of the mine and at the same time to form two large intersecting circular openings which begin to define the borehole. The cutting heads are also counter rotating so as to have the tendency to move mined material toward the center of the borehole.

Just behind the counter rotating, multi-armed cutting heads are two vertical drum-type cylindrical cutters. These two vertical drum cutters act to form both the substantially vertical walls that intersect the circular openings formed by the counter rotating, multi-armed cutting heads, and the flat, horizontal portion of the opening, which defines the floor of the borehole. The drum cutters are also counter rotating to move material toward the center of the borehole much like the multi-armed cutting heads.

Between the two vertical drum cutters and behind the pair of counter rotating, multi-armed cutting heads is a plow or scoop assembly. The plow or scoop assembly provides two functions. First, the plow or scoop assembly removes the lower kerf on the floor of the borehole produced by the cutting action of the two counter rotating, multi-armed cutting heads to create a substantially flat floor in the borehole. Second, the plow or scoop assembly guides the mined material into a funnel, chute, or gathering area. The exit end of the funnel or chute opens onto a short conveyor that is integral to the miner chassis. The conveyor transports the mined material to the rear of the mining machine and subsequently out of the borehole.

At the top of the mining apparatus, behind the two counter rotating, three-armed cutting heads is a smaller rotating cutting head, which removes the upper kerf at the top of the borehole located at the intersection of the two circular openings formed by the counter rotating, multi-armed cutting heads.

Thus, through the interaction of the two, counter rotating cutting heads, the two vertical drum cutters, the plow or scoop assembly, and the small rotating cutting head at the top of the apparatus, a borehole is formed having the shape of a bread loaf. The bread loaf shaped opening is defined by a generally arched top or ceiling, two substantially vertical side walls, and flat bottom or floor.

Enabling the described cutting system to operate are three cutting support systems. The first cutting support system is the movement or transport system, which continually moves the entire apparatus into the cutting face of the mineral seam. Second, is the conveyor system which receives the mined material falling to the floor of the borehole and then is later picked up by the plow or scoop assembly. The third cutting support system is the computer based controller system. The computer based controller system provides a variety of operational functions and may be configured to enable automatic operation of a remotely operated coal mining system.

Within the controller system are a variety of sensors that gather information regarding the motion of the system, its position and orientation within the mine, the condition and operation of the mechanical equipment, and the environmental conditions within the mine. This sensed information is then processed by the computer within the controller system to produce output signals. These output signals operate the cutting equipment, the transport system, and the conveyor system. In addition, the computer diagnoses operational problems and provides warning or shut-off signals whenever hazardous conditions occur.

BRIEF DESCRIPTION OF THE FIGURES

A better understanding of the mining method and mining apparatus for forming a bread loaf shaped borehole in a mine may be had by reference to the drawing figures wherein.

DETAILED DESCRIPTION

Figure 1:
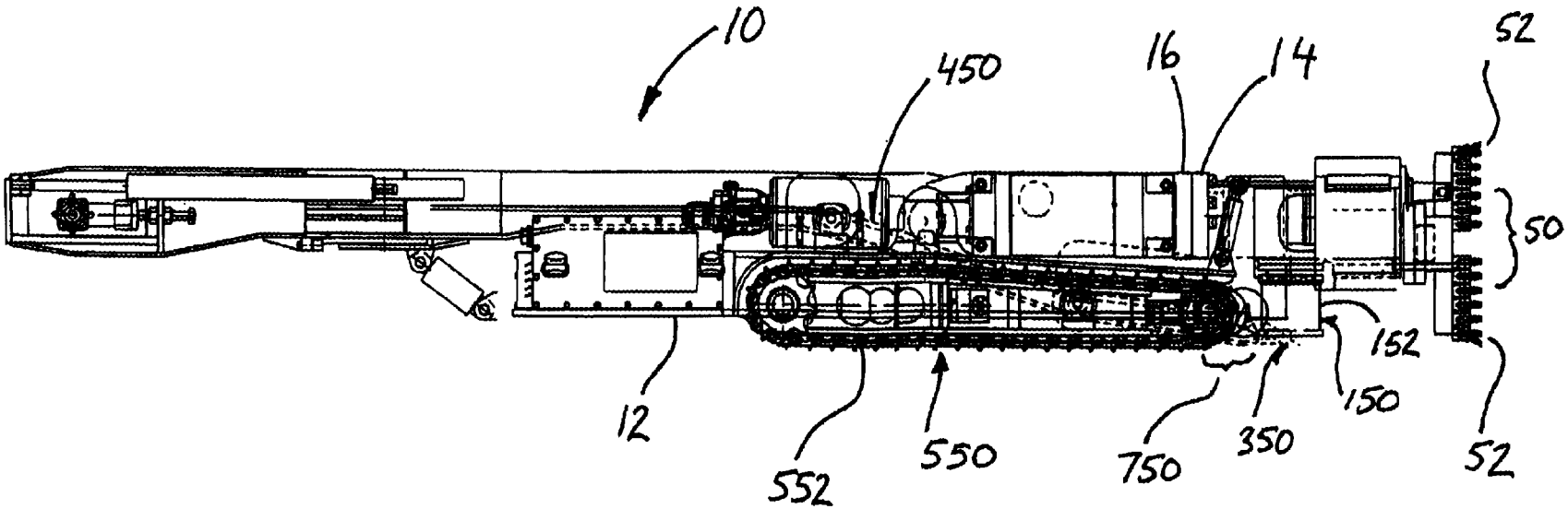
FIG. 1 is side elevational view of the mining apparatus which implements the method of the present invention.

As seen in FIGS. 1 through 5B, the mining apparatus 10, which implements the method of forming a bread loaf shaped borehole in a mine, includes four cutting systems and three cutting support systems.

The first and largest cutting system 50 is a pair of counter rotating, three-armed, substantially vertical cutting heads 52 which engage the mine face 1050.

The second cutting system 150 is a pair of vertical drums 152 which are positioned behind the two counter rotating, three-armed cutting heads 52. The third cutting system 250 is a rotating cutting head 252 which is positioned behind the two, three-armed, counter rotating, cutting heads 52.

The fourth cutting system is a plow or scoop assembly 350 which is positioned substantially between the vertical drum cutter system 150. All of these cutting systems are mounted to a single frame 12. Positioning the two counter rotating, three-armed cutting heads 52 are two substantially vertical plates or flatbacks 14, 16 attached to the frame 12 on which the other portions of the apparatus 10 are mounted.

A continuous track or caterpillar-type tramming system 550 is used to move the chassis or frame 12, and thus the four cutting systems, forward into the mine face 1050. The continuous forward movement of the entire apparatus not only keeps the two counter rotating, three-armed cutting heads 52 in contact with the mine face 1050, but the continuous forward movement also causes the plow or scoop assembly 300 undercut the kerf 1060 (FIG. 6) formed at the bottom of the mine and then scoop up the mined material which has fallen to the floor 1005 of the mine into a chute or funnel assembly 750. The chute or funnel assembly 750 empties at its exit end to a chain conveyor assembly 450 for moving material out of the borehole 1000. Because the system of the present invention is designed to operate remotely within a mine, a computer based controller assembly 650, is used to govern the operation of the apparatus 10 as well as sensing operational and atmospheric parameters within the mine. The following paragraphs further defines the various aspects of the method and apparatus 10 of the present invention in greater detail.

Counter Rotating, Three-armed Cutting Heads

Figure 3:
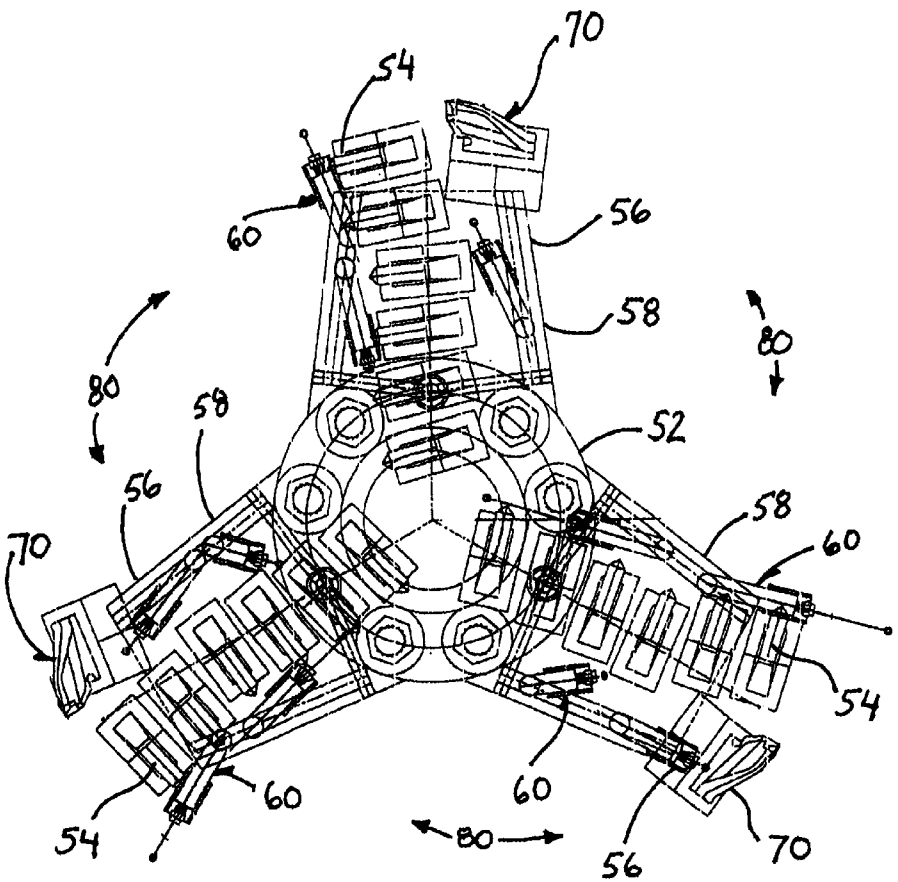
FIG. 3 is a front elevational view of the three-armed cutting head, looking back from the mine face, showing the positions at which the mechanical bits and the water jet assemblies are installed.

As may be seen in the single cutting head 52 depicted in FIG. 3, the two vertical, counter rotating, three-armed cutting heads 52 are substantially identical in design. Each of the two counter rotating, three-armed cutting heads use both fixed mechanical bits 54 and water jet nozzle assemblies 60 for removing material from the mine face 1050. While the high pressure water streams from the water jet assemblies provide cooling, dust control, and score lines in the mine face to enhance the effectiveness of the mechanical bits, the force of the water stream emitted from the water jet assemblies 60 is sufficient such that material may be removed from the mine face 1050 solely by using the water jet assemblies 60 even without contact between the bits 54 and the mine face 1050. In short, the water jet assemblies 60 are each positioned to cut the mine face 1050 at different radii and independently of the mechanical bits 54. This unique combination of both mechanical and hydraulic cutting techniques results in faster penetration rates and higher productivity, particularly in softer deposits or seams such as coal.

At the outboard end 56 of each of the three arms 58 are located pivotally mounted bit blocks or assemblies 70 whose radial position is held outward from center by springs. The springs are selected to ensure that the bits are extended during cutting, but also to allow the bits to flex or be pushed inward when the cutting heads are at rest. This pivotable, spring-loaded design is particularly useful upon removal or extraction of the mining machine from the borehole as the difference between the cutting radius and the at rest radius will provide additional mechanical clearance. Alternatively, the arms 58 on each cutting head 52 may be designed to be extended outward, by hydraulic cylinders or other suitable means, during use and later drawn inward to better facilitate removal.

Figure 5B:
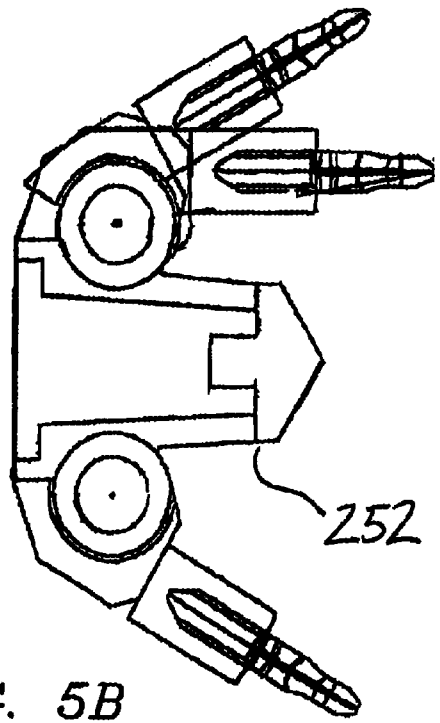
FIG. 5B is a side elevational view of the cutter shown in FIG. 5A.
Figure 5A:
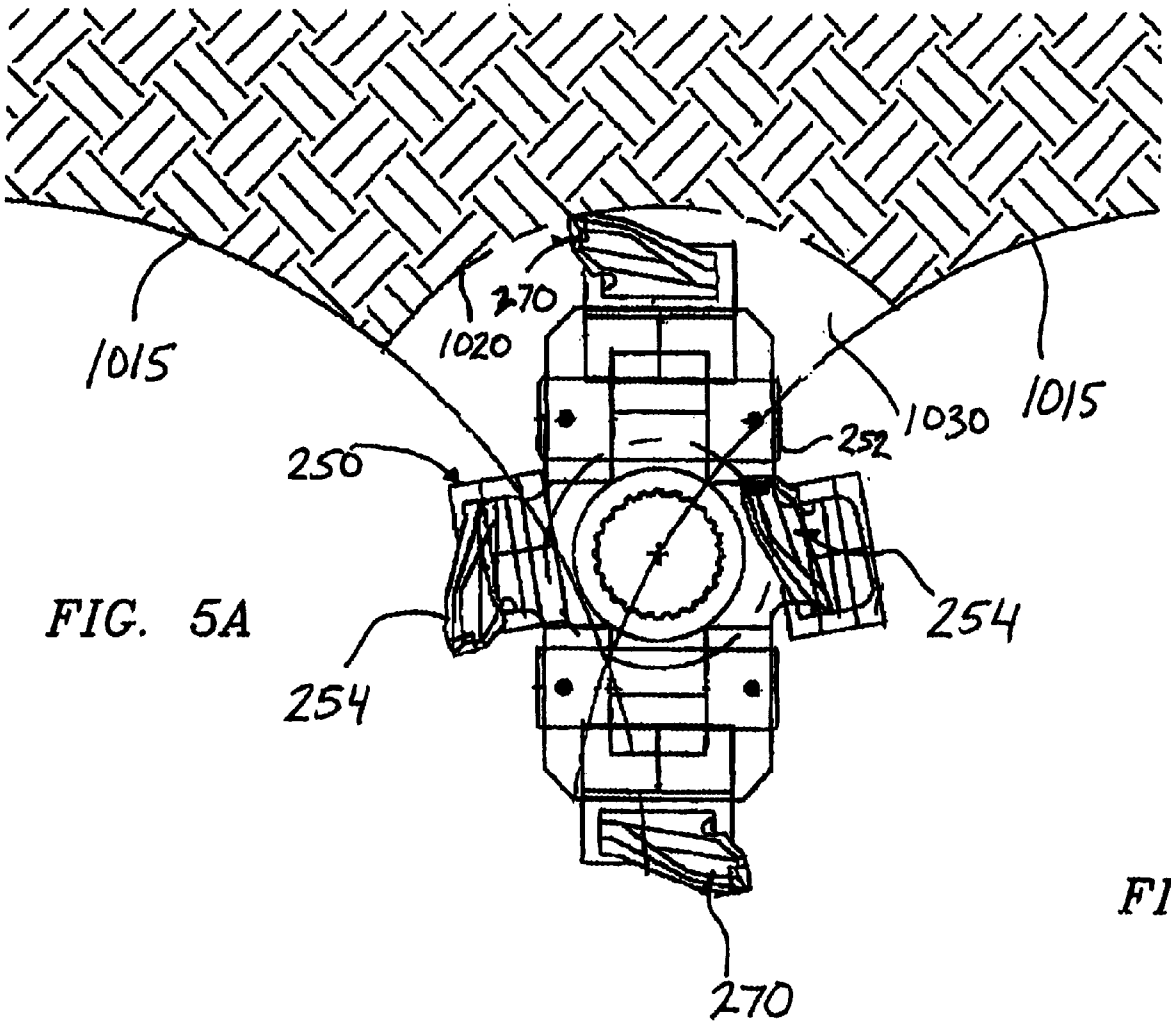
FIG. 5A is a front elevational view of the rotational cutter head for removing the kerf formed at the top of the mine face, looking back from the mine face.

The two counter rotating, three-armed cutting heads 52 are positioned such that the arms on each one of the cutting heads fits within the open space 80 between the arms 58 on the other cutting head. As shown at the top of FIG. 5A and in FIG. 6, the circular cut 1015 formed by the two counter rotating, three-armed cutting heads 52 is effectively two intersecting circles 1015 having an upper kerf 1030 at the top and a lower kerf 1060 at the bottom. The material cut away from the mine face 1050 falls away from the mine face 1050 downward to the floor of the mine 1005 while being moved toward the center of the borehole by the counter rotational motion of the cutting heads 52.

It is also important to note that while a preferred embodiment of the present invention is depicted as having two three-armed cutting heads other geometries are clearly contemplated, and that it may be useful to implement two, four, or even five armed cutting heads. The various cutting head arm configurations being limited only by the mechanical strength required for each arm to cut effectively and the space required for each arm of one cutting head to intermesh properly with the open spaces provided by the other cutting head.

Vertical Drum Cutters

Figure 2:
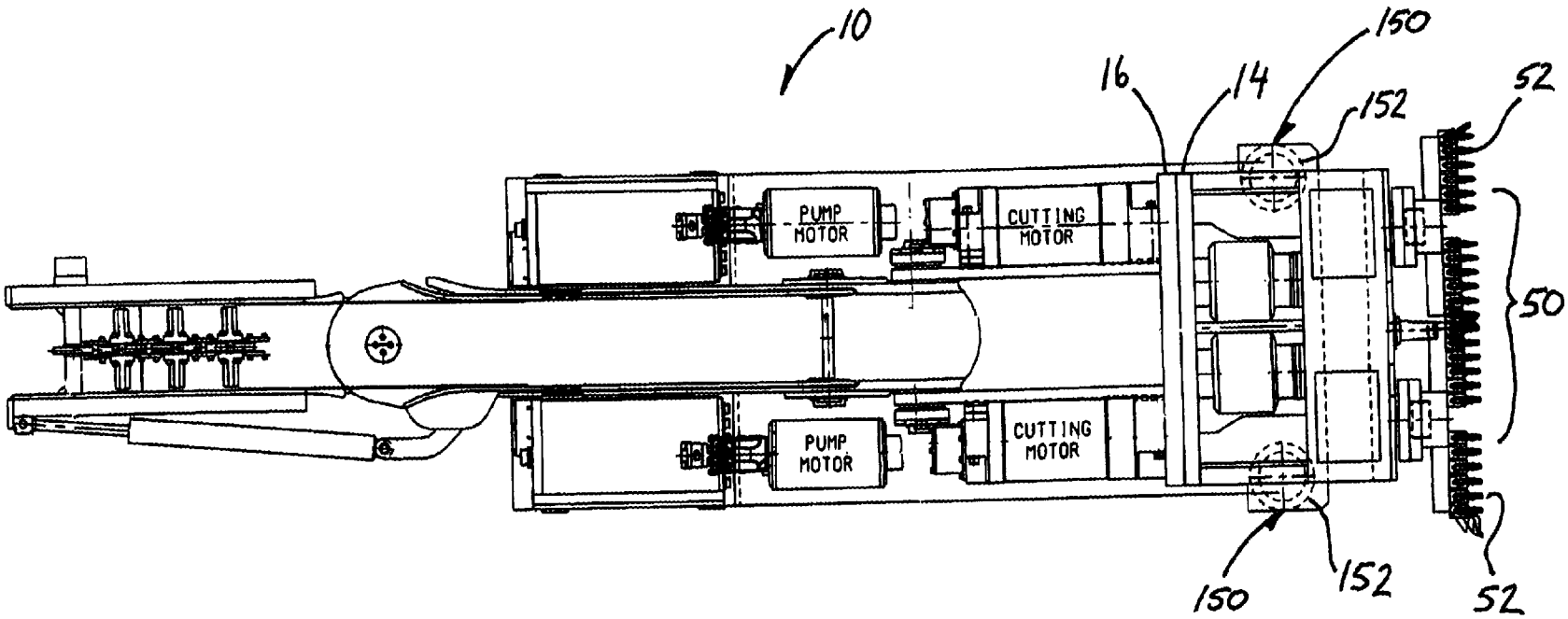
FIG. 2 is a top plan view of the mining apparatus shown in FIG. 1.
Figure 4:
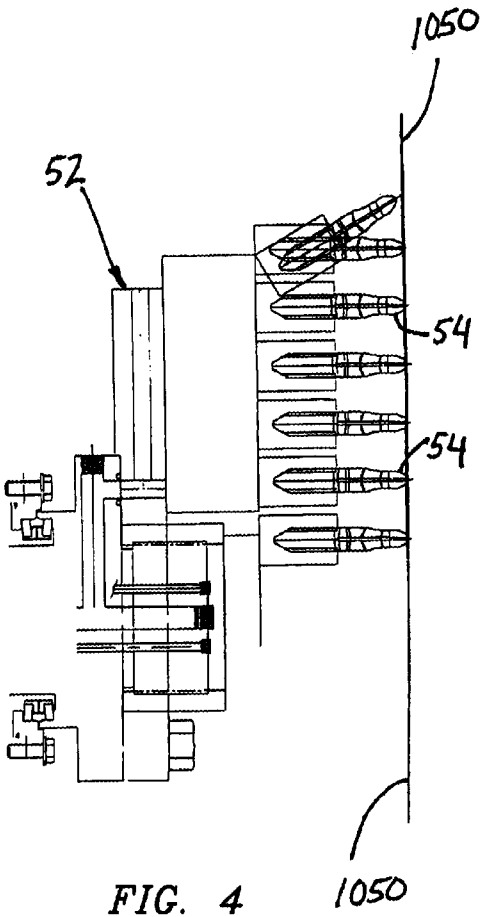
FIG. 4 is a side elevational view of the mechanical bits in contact with the mine face.
Figure 6:
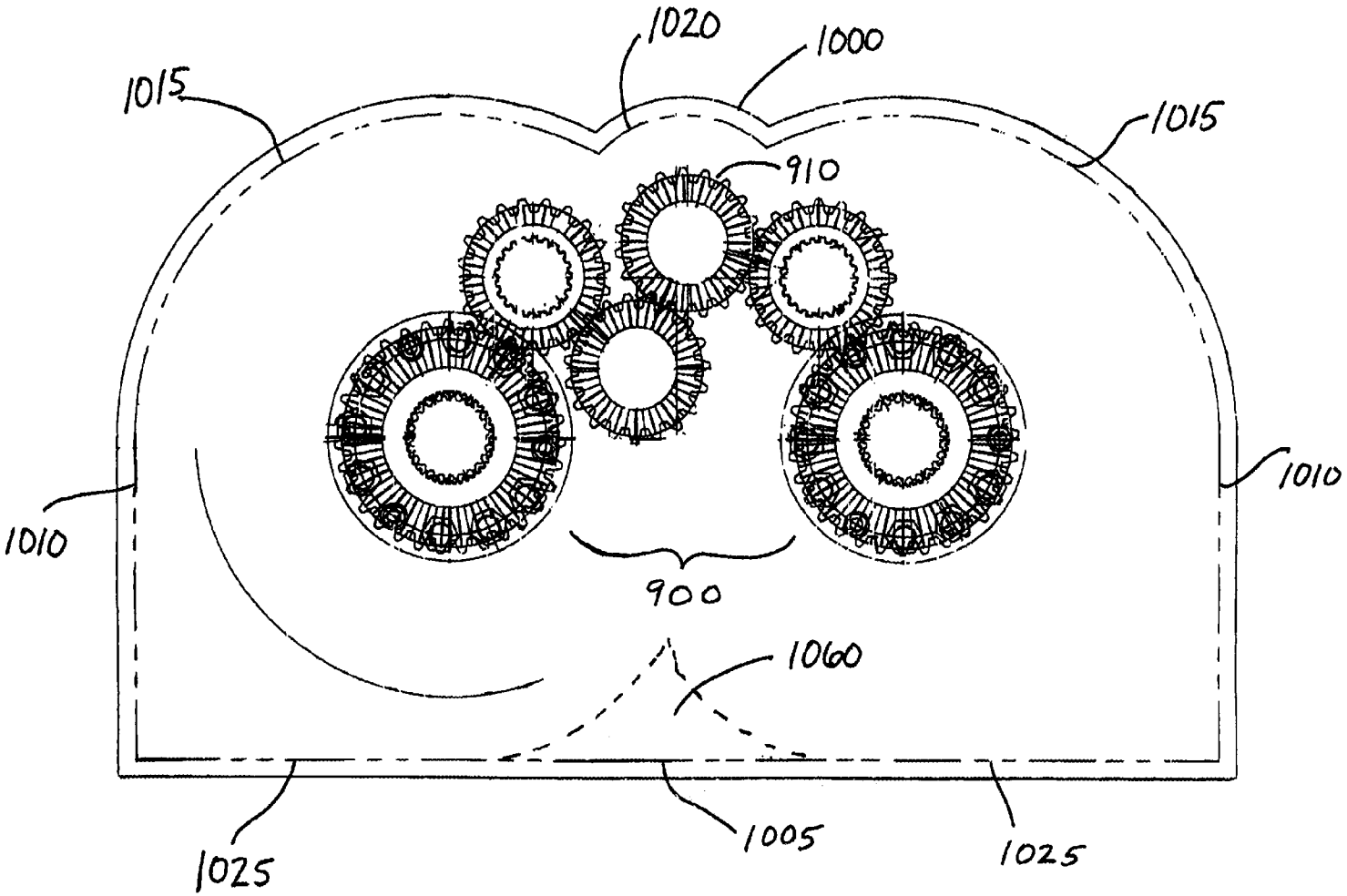
FIG. 6 is a front elevational view of the drive assembly for the three arm cutting heads and the cutting head for removing the kerf at the top of the borehole, looking back from the mine face, shown within the outline of the bread loaf shaped borehole.

As may be seen in FIGS. 1 and 2, a pair of vertical drum-type cutters 152 are positioned behind the two counter rotating three-armed cutting heads 52. The outer surface of each of the drum cutters 152 is studded with a plurality of mechanical bits which have a pattern or scroll much like the cylinder which produces music in a musical box. Additionally, much like the three-armed cutting heads 52 the drum cutters 152 may be provided with water jet assemblies, not shown, to assist in cutting. As shown in FIG. 6, the vertical drum cutters 152 form substantially vertical walls 1010 which extend downwardly from and tangent to the portion of the circular cuts 1015 formed by the two counter rotating, three-armed cutting heads 52. The two vertical drum cutters 152 also form a substantially horizontal portion 1025 on the floor or bottom 1005 of the borehole 1000. The counter rotation of the two vertical drum cutters 152 causes the mined material to move toward the center of the borehole 1000 for pick up by the plow or scoop assembly 350. Although these drum cutters 152 are illustrated herein as fixed, it is to be understood that hydraulic cylinders or other means may be incorporated into the apparatus to permit extending the drum cutters 152 outwardly from the machine.

Kerf Cutter

As shown in FIG. 5A, there is an area of unmined material or kerf 1030 which is located at the top of the borehole 1000 in the space between the generally circular cuts 1015 made by the two counter rotating, three-armed cutting heads 52. This upper kerf 1030 is removed by a smaller, rotating cutting head assembly 250 which is positioned behind and between the two counter rotating, three-armed cutting heads 52. The top kerf 1030 cutter 252 includes two fixed mechanical bits 254. As in the counter rotating, three-armed cutting heads 52, there are also two outer bit assemblies 270 on the cutter 252 which are pivotally mounted and spring-loaded to maintain their maximum cutting diameter. As noted earlier, the spring-loaded bit assemblies allow the cutter 252 to conform to a smaller diameter than the hole which it forms and makes removal from the borehole easier. Of course, the kerf cutting assembly may also have high pressure water jet assemblies, not shown, to assist in cutting.

As may be seen in FIG. 6, the kerf cutter assembly 250 is driven by a gear drive system 900 which drives the two counter rotating, three-armed cutting heads 52. Specifically, the gear train 900 is used to provide rotational force to a drive gear 910 which is attached to the back of the top kerf 1030 cutter 252. As may be further seen in FIG. 6, the resulting outline 1000 of the borehole includes two substantially circular portions 1015 on either side, a substantially circular section 1020 connecting the two substantially circular sections 1015 on either side, two substantially vertical wall sections 1010, and a substantially flat floor 1005.

The Plow or Scoop Assembly

Positioned between and behind the two counter rotating, three-armed cutting heads 52 is a scoop or plow assembly 350. The scoop or the plow assembly 350 removes the lower kerf 1060 formed at the bottom of the borehole 1000 as shown by the dotted lines appearing in FIG. 6. This scoop or plow assembly 350 not only removes the kerf, but also causes the mined material which has fallen away from the mine face 1050 and been moved toward the center of the borehole by the action of the two counter rotating, three-armed cutting heads 52 and the two vertical drum cutters 152 to flow into a chute or a funnel assembly 750 which is located behind the plow or scoop assembly 350. Of course, this material collection function of the scoop or plow assembly 350 may be further enhanced by adding gathering arms, not shown, or other means known in the art. As may be seen in FIG. 1, a short chain conveyor 450 follows the plow or scoop assembly 350 and causes the mined material which is moved upwardly by the plow or scoop assembly 350 to move rearwardly out of the borehole 1000. The speed of operation of the chain conveyor 450 is sufficient so that it is able to convey more mined material than is produced by the material removal action of the four cutting systems.

In one alternative embodiment, another circular kerf cutting assembly, similar to that described earlier, may be used to remove the lower kerf 1060. In another alternative embodiment, a small horizontal, drum-type cutter, not shown, may be used to remove the lower kerf 1060 and to assist in moving mined material from the floor 1005 of the borehole 1000 into the funnel assembly 750. Any of these three alternative embodiments may be further modified by the addition of high pressure water jet assemblies, not shown.

Tramming or Positioning System

The first of the three cutting support systems is the tramming or positioning system 550. The tramming or positioning system 550 is mounted to the frame 12 as shown in FIG. 1. Included in the tramming or positioning system 550 are a pair of endless chain crawlers 552. Continuous movement of these two parallel endless chain crawlers 552 moves the four cutting systems toward or away from the mine face 1050. This movement also causes the plow or scoop assembly 350 to undercut the kerf 1060 on the floor of the borehole 1005 and remove the mined material which has fallen from the mine face 1050 to the floor of the mine 1005 and move it into the chute or funnel assembly 750. At the exit end of the chute or funnel assembly 750, the mined material is guided to the conveyor assembly 450 for removal from the borehole. Simultaneous movement of the two parallel endless chain crawler assemblies 552 will cause the mining apparatus 10 to move straight ahead. Should it be desired to turn the mining apparatus 10 within the borehole 1000 the endless chain crawlers 552 are moved at a different rate. When it is desired to remove the apparatus 10 from the borehole 1000 the direction of rotation of the endless chain crawlers 552 are simply reversed.

The Conveyor Assembly

The second of the two cutting support assemblies is the chain conveyor assembly 450. The front end of the chain conveyor assembly 450 is positioned in close proximity to the exit end of the chute of a funnel assembly 750 to receive the mined material which has been picked up from the floor of the borehole 1005 by the scoop or plow assembly 350 as the machine is advanced into the borehole. The chain conveyor assembly 450 is designed so that it will move more material than is produced by the four cutting systems. Thus, there will be no blocking of the forward movement of the apparatus 10 by mined material. The chain conveyor 450 moves material the length of the apparatus 10 and may further dump the mined material onto a separate transportation system which follows the apparatus 10 of the present invention.

The Controller

Figure 7:
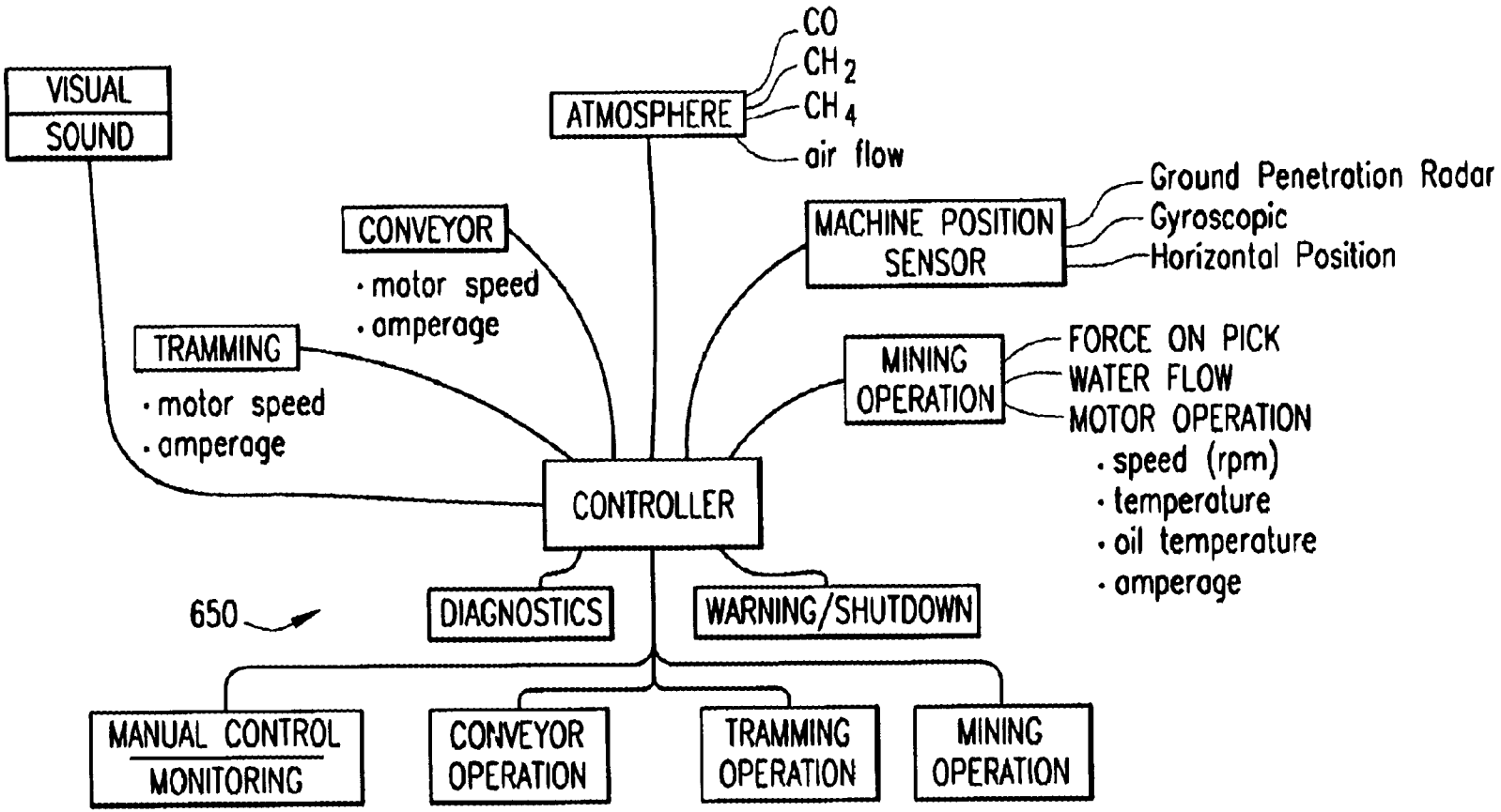
FIG. 7 is a schematic of the computer based controller system.

As may be seen in FIG. 7, the computer based controller 650, which is the third cutting support system, includes three portions. The first portion, shown on the top of FIG. 7, is an input system which senses operating conditions within the mine. The second portion, shown in the middle of FIG. 7, is a processing portion which receives and analyzes the information received from the various inputs into the controller 650. And the output portion, shown on the bottom of FIG. 7, is the system which provides signals to the operating portions of the apparatus 10 and also to the control or monitoring function which normally takes place well above the borehole at ground level. In the instant invention, the processing of information may take place within the mine, on the surface, or a combination of both.

As may be further seen in FIG. 7, the sensed operation of the cutting away of the material from the mine face 1050 includes inputs such as the force on the mechanical bits, the flow of water through the high pressure water jet assemblies 60, and the operation of the various motors which operate the four cutting systems. Motor operational parameters include the rpm of the motor, the temperature of the motor, the temperature of any oil used to lubricate the motor, and the power or amount of amperage being used to run the motor. The actual forces or stresses encountered by the mechanical bits may be measured by using sensitized picks which are essentially bits having stress or pressure transducers embedded within the bit blocks. A sensitized pick can assist the computer based controller in guiding the mining machine by noting differences in the cutting resistance between softer minerals such as coal and harder rock strata.

In addition to receiving inputs on the actual operation of the cutting systems used to remove material from the mine face 1050, the controller 650 also receives inputs from sensors which reveal the position of the apparatus 10 within the borehole 1000 of the mine. Not only do the sensors report back on the horizontal and vertical orientations of the apparatus 10, but they may also provide feedback on the material being mined. This is accomplished by the use of ground penetrating radar which enables the controller 650 to receive inputs as to where the material to be mined is located with respect to the various cutting systems.

Also providing input to the controller 650 are a plurality of atmospheric sensors. Such atmospheric sensors may sense the amount of methane in the mine, the amount of carbon monoxide, the amount of carbon dioxide, and the air flow rate within the mine.

Further sensors may monitor the operation of the chain conveyor 450. Specifically, the speed of the conveyor and the electrical power being supplied to the motor which drives the conveyor 450 may be monitored.

Also, providing sensory input to the controller 650 are sensors mounted on the tramming or moving apparatus 550 for the apparatus 10. Herein the speed of each one of the two endless chain crawlers 552 may be monitored as well as the power provided to the motors for moving the endless chain crawlers 552.

If desired, the system may also include both television cameras and microphones for both watching and listening to the actual cutting of the mined materials at the mine face 1050 at the end of the borehole 1000.

The controller 650 is built around a central computer which receives the various inputs which have been described above. The information received from the various inputs is processed to provide outputs to govern the operation of the apparatus 10. This information may also be used to feed information into a diagnostic program which will determine if there are any problems with the operation of the apparatus 10 and automatically correct those problems. In the case of a severe or problematic condition, the controller will also include systems to provide a warning of a dangerous condition to the operators remotely positioned away from the mining operations, and even possibly shut down the apparatus 10 in the event of a severely dangerous or hazardous condition such as a fire.

The output of the controller 650 not only provides monitoring of the operation of the apparatus 10 to the operators who may be positioned a significant distance away on the surface, but may also allow manual overrides to various control parameters. While the control parameters are generally designed to be automatic; that is, the controller 650 will sense what needs to be done for efficient mining and make appropriate corrections in its position and operation, it will be possible to manually override such automatic control. Automatic feedback will be provided to the various different cutting systems, as well as to the tramming or positioning system 550 to assure that the apparatus 10 moves forward and tracks into the mine face 1050. Additionally, and as previously indicated, the speed of the conveyor 450 will be controlled such that it is sufficient to always move mined material away from the mine face 1050 and out of the borehole 1000 at a rate which is faster than the rate at which the cutting systems are producing mined material.

While the method and apparatus for forming a bread loaf shaped borehole in a mine has been described in accordance with its preferred embodiment, it will be understood by those of ordinary skill in the art that numerous other embodiments of the present system may be fabricated by those or ordinary skill in the art. Such other embodiments shall fall within the scope and meaning of the appended claims.

What is claimed is:

1. A mine defining an aperture created by excavation for extracting material from a mine face, said mine comprising:

a plurality of intersecting substantially arcuate roof sections;

a pair of substantially vertical walls intersecting said plurality of substantially arcuate roof sections; and a substantially horizontal generally planar floor intersecting said substantially vertical walls;

wherein said mine aperture is defined by said plurality of arcuately intersecting roof sections disposed between said pair of substantially vertical walls such that said substantially vertical walls further intersect said substantially horizontal generally planar floor, thereby creating and forming a bread loaf shaped borehole mine aperture.

2. A method of making a borehole for a mine, said method comprising the steps of:

making two substantially vertical circular cuts against the face of the mine, said cuts made by two substantially vertical counter-rotating cutting heads;

removing the kerf at the upper intersection of said two substantially vertical circular cuts, said kerf at the upper intersection removed using at least one substantially vertical rotating cutting head;

removing the kerf at the lower intersection of said two substantially circular vertical cuts, said kerf at the lower intersection removed using a plow type apparatus; and forming substantially vertical walls extending downwardly from said substantially circular vertical cuts and forming a substantially horizontal floor between said two substantially vertical walls, wherein said vertical walls are formed using at least two substantially vertically oriented counter-rotating drums.

3. An apparatus for forming a borehole in a mine, said apparatus comprising:

a first cutting head constructed and arranged to rotate in a substantially vertical cutting plane, wherein said first cutting head has a plurality of bit assemblies pivotally mounted, wherein said bit assemblies comprise a plurality of springs for maintaining a radial position, thereby allowing maximum cutting diameter and further allowing ease of retraction of said cutting heads from said borehole, said first cutting head further comprising a plurality of water jet nozzle assemblies for removing material from a mine face;

a second cutting head constructed and arranged to rotate in said substantially vertical cutting plane in a direction opposite to the rotation of said first cutting head, wherein said second cutting head has a plurality of bit assemblies pivotally mounted, wherein said bit assemblies comprise a plurality of springs for maintaining a radial position, thereby allowing maximum cutting diameter and further allowing ease of retraction of said cutting heads from said borehole, said second cutting head further comprising a plurality of water jet nozzle assemblies for removing material from a mine face;

said first and second cutting heads each having a plurality of arms and open spaces therebetween, said arms and open spaces constructed and arranged so that said arms on said first cutting head intersect said open spaces in said second cutting head when said first and second cutting heads are rotated;

a pair of substantially vertical counter-rotating cutting drums positioned behind said first and second cutting heads;

a plurality of water jet nozzle assemblies disposed upon said pair of counter-rotating cutting drums;

a cutting head constructed and arranged to remove the kerf formed in said cutting plane between said first and second cutting heads at the top of the mine face, said cutting head having a plurality of bit assemblies pivotally mounted, wherein said bit assemblies further comprise a plurality of springs for maintaining a radial position, thereby allowing maximum cutting diameter and further allowing ease of retraction of said cutting heads from said borehole; and a plow constructed and arranged to remove the kerf formed in said cutting plane between said first and second cutting heads at the bottom of the mine face.

4. The system as defined in claim 3 further including means for conveying the mined material away from the mine face.

5. The system as defined in claim 4 further including a funnel assembly following said plow for directing said mined material to said means for conveying the mined material away from the mine face.

6. The system as defined in claim 4 wherein said means for conveying the mined material away from the mine face is a chain conveyor.

7. The system of claim 4 wherein said means for conveying includes gathering arms.

8. The system as defined in claim 3 further including means for continuously moving the system into the mine face.

9. The system as defined in claim 8 wherein said means for continuously moving the system into the mine face is a continuous crawler system.

10. The system as defined in claim 9 wherein said continuous crawler system includes two parallel endless tracks.

11. The system as defined in claim 3 wherein said first and second cutting heads include a plurality of bit assemblies constructed and arranged to contact the mine face and remove material.

12. The system as defined in claim 11 further including pivotally mounted bits on said first and second cutting heads.

13. The system as defined in claim 3 wherein said first and second cutting heads include a plurality of high pressure water jets constructed and arranged to remove material from the mine face.

14. The system as defined in claim 3 wherein said cutting head for removing the kerf formed in said cutting plane between said first and second cutting heads at the top of the mine face includes mechanical bits.

15. The system as defined in claim 14 wherein the cutting head for removing the kerf formed in said cutting plane between said first and second cutting heads at the top of the mine face also includes pivotally mounted bits.

16. The system as defined in claim 3 further including a controller for governing the operation of said first cutting head, said second cutting head, said rotating cutting drums, and said cutting head removing the kerf at the top of the mine face, and said plow for removing said kerf at the bottom of the mine face.

17. The system as defined in claim 16 wherein said controller includes:

(a) an input portion for sensing conditions within the mine face, (b) a portion for processing the information received from said system for receiving information from within the mine, and (c) an output portion for providing control signals to said system for removing material from the mine face.

18. The system as defined in claim 17 wherein said input portion includes sensors selected from a group including sensors for determining:

the operation of the motors used to drive the system;

the position of the system within the borehole of the mine;

the atmospheric conditions within the mine;

the operation of the conveyor;

the operation of the tramming system.

19. The system as defined in claim 17 wherein said processing portion of said controller includes segments selected from a group including a operational control portion, a diagnostic section, and a warning and shutdown section.

20. The system as defined in claim 16 wherein said output section of said controller includes segments selected from a group including the following:

control of mining operations;

control of system position;

control of conveyor operation;

monitoring of the operation of the system and conditions within the mine.

* * * * *